United States Patent [19]

Kawana et al.

[11] Patent Number: 4,785,734

[45] Date of Patent: Nov. 22, 1988

[54] APPARATUS FOR CONTROLLING PAPER TRANSFER SPEED OF A PRINTING SECTION OF A FORM PRINTING MACHINE

[75] Inventors: Fujio Kawana, Kure; Akinobu Hanyu, Higashihiroshima, both of Japan

[73] Assignee: Fuji Kikai Kogyo Co., Ltd., Hiroshima, Japan

[21] Appl. No.: 114,807

[22] Filed: Oct. 29, 1987

[30] Foreign Application Priority Data

Nov. 4, 1986 [JP] Japan ..... 61-263522
Nov. 4, 1986 [JP] Japan ..... 61-263523

[51] Int. Cl.[4] ..... B41F 5/04
[52] U.S. Cl. ..... 101/219; 101/220
[58] Field of Search ..... 101/216, 217, 219, 220, 101/221, 225, 228, 178, 179, 180, 181

[56] References Cited

U.S. PATENT DOCUMENTS

| | | | |
|---|---|---|---|
| 2,758,541 | 8/1956 | Tison | 101/228 |
| 3,280,737 | 10/1966 | Huck | 101/225 |
| 3,732,815 | 5/1973 | Greiner et al. | 101/220 |
| 3,742,849 | 7/1973 | Greiner et al. | 101/220 |
| 4,177,730 | 12/1979 | Schriber et al. | 101/228 |
| 4,240,346 | 12/1980 | Landis et al. | 101/228 |
| 4,394,835 | 7/1983 | Gertsch et al. | 101/220 |
| 4,437,402 | 3/1984 | Fischer | 101/228 |
| 4,508,033 | 4/1985 | Fischer | 101/228 |

*Primary Examiner*—Eugene H. Eickholt
*Attorney, Agent, or Firm*—Jordan and Hamburg

[57] ABSTRACT

In a form printing machine having a printing section provided with a printing unit comprising a plate cylinder, a blanket cylinder and an impression cylinder, a change speed means for changing the rotation speed of the impression cylinder independently of the plate cylinder and the blanket cylinder is provided.

2 Claims, 12 Drawing Sheets

APPARATUS FOR CONTROLLING PAPER TRANSFER SPEED OF A PRINTING SECTION OF A FORM PRINTING MACHINE

BACKGROUND OF THE INVENTION AND RELATED ART STATEMENT

The present invention relates to an apparatus for controlling paper transfer speed of a printing section of a form printing machine which carries out successive steps from multicolor printing on a paper web to processing, such as punching and perforating.

The whole structure of a multicolor form printing machine is shown in FIG. 13 of the appended drawings. In this Figure, there is illustrated a paper feeding section 1 for transferring a paper web P from a roll, a printing section 2 for achieving multicolor offset printing on the fed paper web P, a processing section 3 for processing, for example, punching, perforating and the like the printed paper web P which is transferred from the printing section 2, and a paper discharge section for discharging the printed and processed paper web into a zigzag folded stack.

In the printing section 2, printing units 5 are arranged on a printing line. The number of the printing units 5 coincides with the number of colors used in the multicolor printing, and in FIG. 13, four printing units which coincide with the four color printing are arranged. The paper web P is successively passed through each of the printing units 5 . . . and printed in multicolor. Each printing unit 5 comprises a plate cylinder 6, a blanket cylinder 7 formed of an elastic material such as rubber onto which images on the plate cylinder are transferred and a metal impression cylinder 8, these three cylinders being rotatably supported by a printing cylinder support in such a manner that their circumferential surfaces are substantially in contact with one another. The paper web P is passed between the blanket cylinder 7 and the impression cylinder 8, where the image transferred from the plate cylinder 6 onto the blanket cylinder 7 is printed on the paper web P.

As shown in FIG. 10, the rotatory power of a drive motor(not shown) is transmitted through a drive shaft 11 to each of the printing unit 5. The drive shaft 11 is extended over the paper feed section 1 and all of the printing units 5 . . . of the printing section 2. The rotatory power of the drive shaft 11 is transmitted through a transmission device 12 such as a worm gear mechanism to an infeed roll 10 and through a transmission gear 13 to the plate cylinders 6 of the printing units 5 . . . .

As shown in FIG. 11, spur gears 14, 15, 16 are mounted respectively on the rotatory shafts 6a, 7a, 8a respectively of the plate cylinder 6, the blanket cylinder 7 and the impression cylinder 8 of each printing units 5. And through the rotation of the spur gears 14, 15, 16 being in engagement with one another, the rotatory force of the drive shaft 11 is transmitted to the plate cylinder 6, the blanket cylinder 7 and the impression cylinder 8. Thus, these cylinders 6, 7, 8 are rotated.

In this case, the speed of transfer of the paper web P(hereinafter referred to as the paper transfer speed) of the printing unit 5 is controlled by the rotation speed of the blanket cylinder 7 and the impression cylinder 8, but it is also changed in accordance with the change of the thickness of the paper web P. Namely, in FIG. 12, if d is the diameter of the impression cylinder 8; N is the rotation frequency of the impression cylinder 8; t is the thickness of the paper web P; and V is the paper transfer speed, a formula $$V=N(d+t)\pi$$

is obtained. And therefore, as the thickness t of the paper web P (hereinafter referred to as the paper thickness t) increases, the paper transfer speed V rises and the paper transfer amount per a unit time increases.

In the case of the blanket cylinder 7, the change of the paper thickness is compensated by the diameter change through the elasticity of the blanket cylinder 7, and therefore, the paper transfer speed is changed by the relation of the nonelastic impression cylinder 8 and the paper thickness. In other words, the paper transfer speed is determined by the rotation speed of the impression cylinder 8 and the paper thickness. Further, generally in a business form printing machine, the paper thickness changes within the range from 0.05 mm to 0.2 mm. Therefore, relating to the paper transfer speed V, the following formulas are obtained.

Minimum value $$V\,\mathrm{min}=N(d+0.05)\pi$$

Minimum value $$V\,\mathrm{max}=N(d+0.2)\pi$$

In a conventional printing machine, however, since the impression cylinder 8 is always rotated together with the blanket cylinder 7 at a predetermined speed, independently of the paper thickness, the paper transfer speed changes with the change of the paper thickness. As a result, the following problems have been caused.

1. In the printing unit 5, monocolor or multicolor, the change of the paper transfer speed with respect to the blanket cylinder 7 rotating at a constant speed (i.e. the change of the printing pitch) causes the unevenness of the printing precision.

2. Due to the change of the printing pitch, the tension of the paper web P of the printing section 2 become different from that of the foregoing paper feed section 1 or of the following processing section 3. Consequently, a high tension is applied to the paper web P and a paper transfer mechanism, which causes the paper web P to be broken and the life span of the paper transfer mechanism to be shortened.

3. In multicolor printing, the difference of the diameters of the impression cylinders of the printing units 5 causes the difference of the paper transfer speed between the printing units i.e. the difference of the printing pitch therebetween, whereby the similar problems have arosen.

An object of the present invention is to overcome the abovementioned problems by providing an apparatus for controlling paper transfer speed of a printing section of a form printing machine.

Other objects and advantages of the present invention will become apparent from the following description.

SUMMARY OF THE INVENTION

According to the present invention, in a form printing machine in which a plurality of printing units each comprising a plate cylinder, a blanket cylinder and an impression cylinder are arranged on a printing line so as to constitute a printing section, a first and a second drive shafts driven by a single motor as a drive source are provided so as to extend over all of the printing units of the printing section, the plate cylinder and the blanket cylinder of each printing unit being interlockingly connected to the first drive shaft and the impression cylinder being interlockingly connected to the second drive shaft, and at the end of the second drive shaft on the side of the drive source, there is provided a speed change means for changing the rotation speed of the second drive shaft independently of the first drive shaft.

With this arrangement, the rotation speed of the impression cylinder of each printing unit, namely, the paper transfer speed can be controlled in correspondence with the change of the paper thickness, whereby the printing pitch can be suitably maintained.

Further according to the present invention, in a form printing machine in which each printing unit of a printing section comprises a plate cylinder, a blanket cylinder and an impression cylinder and a rotatory power from a single drive source is successively transmitted to each of these cylinders by means of a rotatory power transmission means provided on a rotatory shaft of each cylinder, there is provided between the rotatory power transmission means of the blanket cylinder and that of the impression cylinder, a speed change means for changing the rotation speed of the impression cylinder independently of the plate cylinder and the blanket cylinder.

With this arrangement, the rotation speed of the impression cylinder, of each printing unit 5, namely, the paper transfer speed can be controlled in accordance with the change of the paper thickness, the difference of the diameter of the impression cylinder between the printing units and the like, whereby the printing pitch can be suitably maintained.

DETAILED DESCRIPTION OF PREFERRED EMBODIMENTS

The first embodiment of the present invention is shown in FIGS. 1 to 5. Here, in the explanation of this embodiment, the same parts as the parts shown in FIGS. 10 to 13 are indicated with the same numerals and the duplicated description will be voided.

Figure 1:
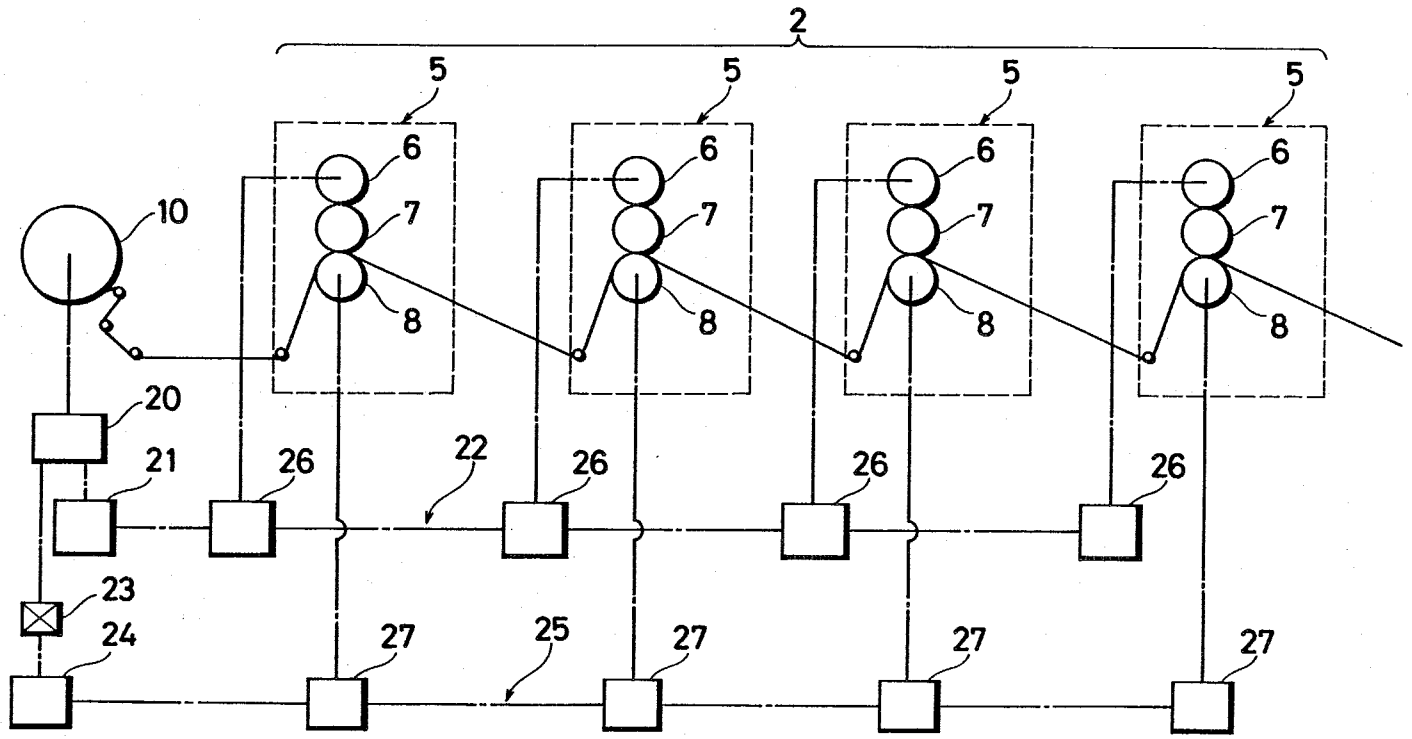
FIG. 1 is a schemetic view illustrating an apparatus for controlling paper transfer speed in the first embodiment of the present invention.

The outline of the whole apparatus is now described with reference to FIG. 1. The rotatory power of a motor (not shown) is transmitted to a first drive shaft 22, and then introduced through a transmission device 21 into the power branching device 20 which uses a combination of spur gears. The output from a power branching device 20 is transmitted to the infeed roll 10 and at the same time transmitted through a differential device 23 functioning as a speed change means to a transmission device 24 and then to a second drive shaft 25. The first and second drive shafts 22, 25 are respectively provided with transmission devices 26 . . . , 27 . . . one per each printing unit 5. Thus, the rotatory power of the first drive shaft 22 is transmitted through each transmission device 26 to the plate cylinder 6 of each printing unit 5, while the rotatory power of the second shaft 25 is transmitted through each transmission device 27 to the impression cylinder 8 of each printing unit 5.

Figure 2:
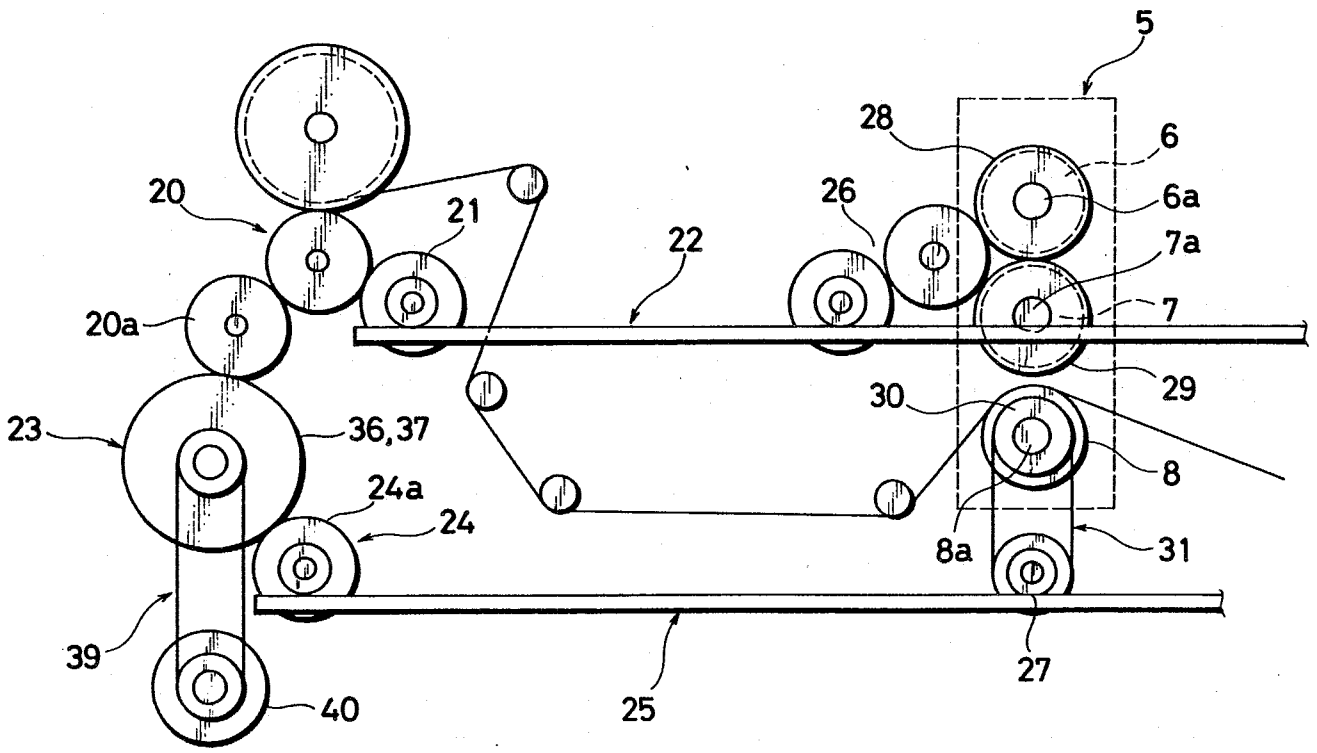
FIG. 2 is a side view illustrating the concrete structure of the apparatus.

The concrete-structure of the power transmission system of each printing unit 5 is shown in FIG. 2. Spur gears 28, 29 are mounted respectively on the rotatory shafts *6a*, *7a* of the plate cylinder 6 and the blanket cylinder 7 in such a manner that the spur gears 28, 29 are in engagement with each other. And the rotatory power transmitted from the first drive shaft 22 to the plate cylinder 6 is transmitted through the spur gears 28, 29 to the blanket cylinder 7. Thereby the plate cylinder 6 and the blanket cylinder 7 are rotated at the same speed and in the opposite directions. On the other hand, the rotatory shaft 8 a of the impression cylinder 8 is interlockingly connected through a belt transmission mechanism 31 to the transmission device 27 of the second drive shaft 25.

As described above, the drive system of each printing unit 5 of the printing section 2 is divided through the two drive shafts 22, 25 into a first drive system for driving the plate cylinder 6 and the blanket cylinder 7 and a second drive system for driving the impression cylinder 8. And at the same time, in the second drive system, a differential device 23 is provided on the side of the drive source. Thus, by means of this differential device 23, the rotation speeds of the impression cylinders 8 . . . of all of the printing units 5 . . . can be controlled collectively and independently of the plate cylinder 6 and the blanket cylinder 7. That is, the paper transfer speed of the printing section 2 can be controlled by means of the differential device 23.

Figure 3:
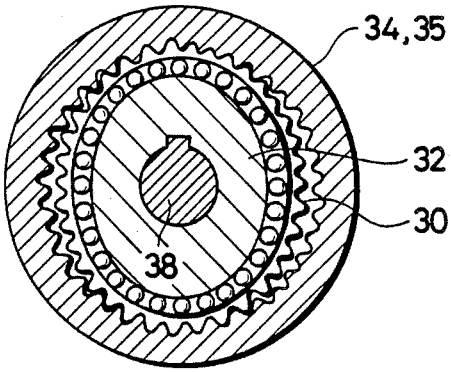
FIG. 3 is a sectional view of a differential device used as a speed changing means.
Figure 4:
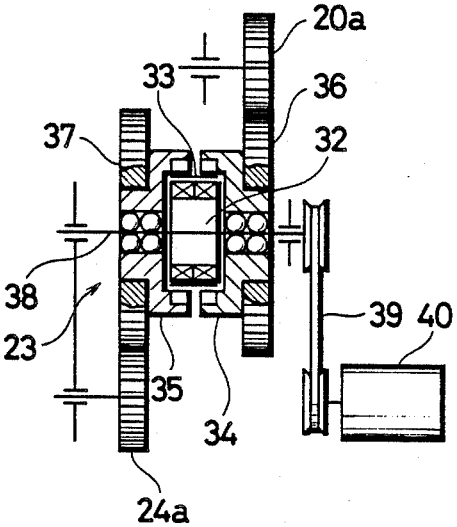
FIG. 4 is a view illustrating the principle of the operation of the differential device.

The structure and the principle of the operation of the differential device 23 will be now described with reference to FIGS. 2 to 4. This differential device 23 is also referred to as a harmonic drive and comprises an ellipsoidal wave generator 32, a flex spline 33 deformable into ellipsoidal form by the rotation of the wave generator 32, and a pair of circular splines 34, 35, each provided with internal teeth which are engageable with the longitudinal portion of the flex spline 33. One circular spline 34 is engaged through a spur gear 36 with an output gear 20 a of the power branching device 20, while the other circular spline 35 is engaged through the spur gear 37 with an input gear 24 a of the transmission device 24. The wave generator 32 is mounted on a regulating spindle 38 so as to be integratedly rotatable with the regulating spindle 38. And the regulating spindle 38 is rotatively driven through a belt transmission mechanism 39 by a regulating motor 40.

The output from the power branching device 20 is transmitted to the transmission device 24 in the course of the spur gear 36→the circular spine 34→the flex spline 33→the circular spline 35→the spur gear 37. On the other hand, the rotatory power of the regulating motor 40 is transmitted in the course of the belt transmission mechanism 39→the regulating spindle 38→the wave generator 32, and by the rotation of the wave generation 32, the flex spline 33 is deformed into an ellipsoidal form and at the same time the longitudinal portion of the flex spline 33 comes into engagement successively with the internal teeth of the circular splines 34, 35. In this case, since the number of the teeth of the flex spline 33 is smaller by a few (e.g. by two) than that of the circular splines 34, 35, the flex spline 33 is moved in the corresponding distance in the direction opposite to the direction of the rotation of the wave generator 32. This movement is taken out as a differential output by the transmission device 24, and thereby the second drive shaft 25 is rotated at the speed determined by the differential device 23.

The output rotation speed of the differential device 23 can be freely changed by controlling the rotation speed of the regulating motor 40, and thereby the speed ratio of the impression cylinder 8 to the blanket cylinder 7 of each printing section can be controlled. When the rotation of the regulating motor 40 is stopped, the ratio of the input speed of the differential device 23 is R:(R+1). Here, R is the reduction gear ratio of the differential device 23.

The rotation speed of the impression cylinder 8 of each printing unit 5, namely, the paper transfer speed of the printing section 2 can be freely controlled as abovementioned. Therefore, the printing pitch can be maintained uniform by reducing the rotation of the impression cylinder 8 thus to lower the paper transfer speed when the paper thickness is larger than the standard value, and by controlling reversely when the paper thickness is smaller. Consequently, it can be surely prevented that the obtained print is blurred due to the disharmony of the rotation speed of the blanket cylinder 7 with the paper transfer speed and that a high tension is applied on the paper web P and the paper transfer mechanism between the printing section 2 and the paper feed section 1 or the processing section 3 due to the change of the printing pitch.

Figure 5:
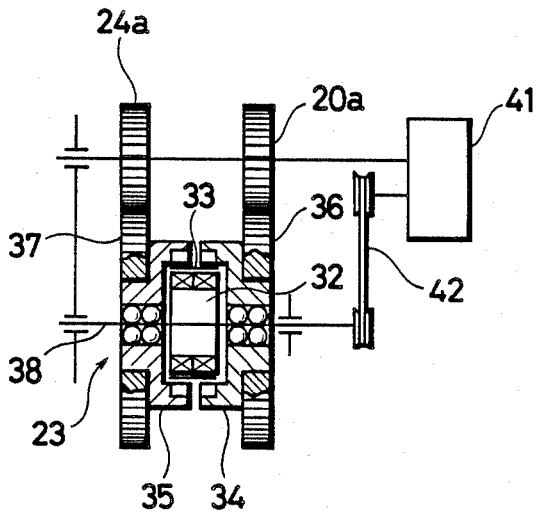
FIG. 5 is a view similar to FIG. 4 illustrating another example of the differential device.

Another example of the differential device 23 is shown in FIG. 5. In the abovementioned embodiment, the regulating spindle 38 is rotatively driven by another drive source i.e. the variable-speed regulating motor 40, but in the example shown in FIG. 5, the rotatory power of the output gear 2a of the power branching device 20 is introduced into a gear type or other speed change device 41 the reduction gear ratio of which can be controlled by manual operation, and the output thereof is transmitted through the belt transmission mechanism 42 to the regulating spindle 38 so as to function as a drive force.

The speed change means for collectively controlling the speeds of the impression cylinders 8 . . . of the printing units 5 . . . is not limited to the abovementioned differential device 23 but may comprise a gear type, belt type or other general speed change device. However, the use of the differential device 23 shown in the abovementioned embodiment is advantageous in that fine speed change control can be thereby achieved with a high accuracy.

In the first embodiment of the present invention, as abovementioned, the drive system of the printing section is devided into two by two drive shafts, the first drive system being used for driving the plate cylinder and the blanket cylinder of each printing unit while the second drive shaft being used for driving the impression cylinder, and the second drive system is provided with a speed change means such as a differential device so that the speed of the impression cylinders of all of the printing units can be controlled collectively and independently of the plate cylinders and the blanket cylinders. Consequently according to the present invention, since the paper transfer speed can be freely controlled in correspondence with the change of the paper thickness, the printing pitch can be always suitably maintained thus to improve the printing precision, and at the same time a high tension can be prevented from being applied on the paper web and the paper transfer mechanism between the printing section and the paper feed section or the processing section whereby the life span of the paper transfer mechanism of each section can be increased.

Then, the second embodiment of the present invention will be described with reference to FIGS. 6 to 9. In the explanation of this embodiment, the same parts as the parts described above are indicated with the same numerals and the duplicated description will be avoided.

Figure 6:
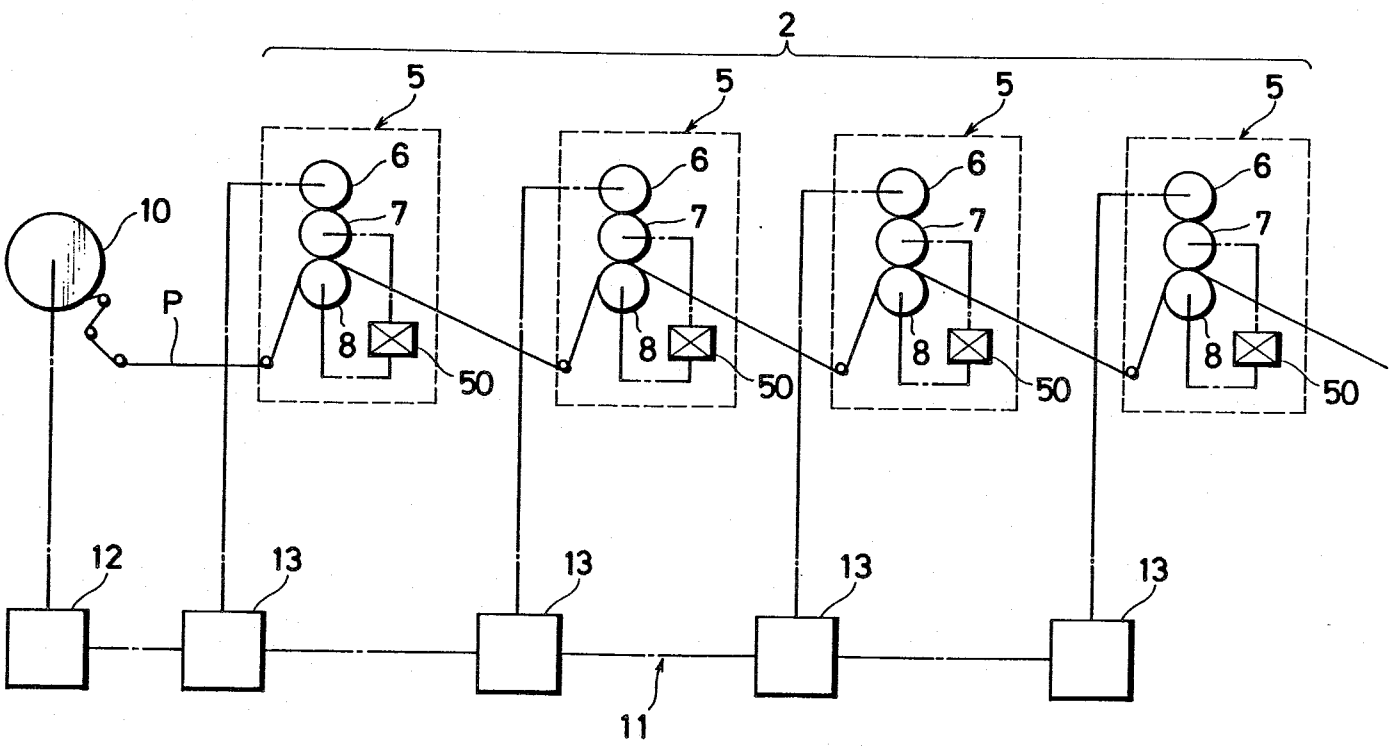
FIG. 6 is a schematic view illustrating the second embodiment of the apparatus according to the present invention.

The outline of the apparatus of the second embodiment will be described with reference to FIG. 6. As abovementioned, the rotatory power of the drive shaft 11 is transmitted through the transmission device 12 to the infeed roll 10 and at the same time transmitted through the transmission device 13 to the plate cylinder 6 of each printing unit 5. Then in each printing unit 5 the rotatory power of the plate cylinder 6 is transmitted directly to the blanket cylinder 7, and the rotatory power of the blanket cylinder 7 is transmitted through the differential device 23 functioning as a speed change means to the impression cylinder 8. By the differential device 23, the rotation speed of the impression cylinder 8 can be controlled independently of the plate cylinder 6 and the blanket cylinder 7, whereby the paper transfer speed can be controlled.

Figure 7:
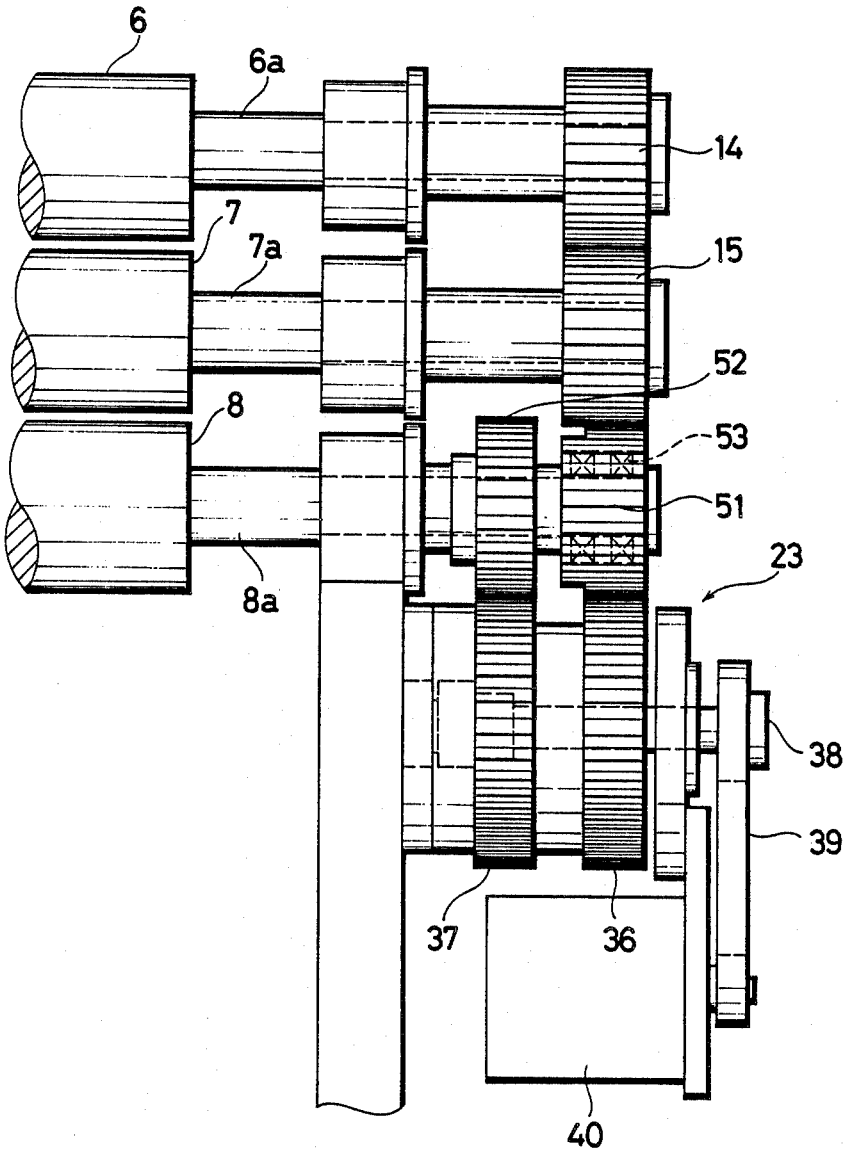
FIG. 7 is a side view illustrating the concrete structure of the apparatus.

The concrete structure of the power transmission system, including the differential device 23, of each printing unit 5 will be described with reference to FIG. 7. The spur gears 14, 15 are mounted respectively on the rotatory shafts **6*a*, 7*a* of the plate cylinder 6 and the blanket cylinder 7 in such a manner that the spur gears 14, 15 are in engagement with each other. On the other hand, two spur gears 51, 52 mounted on the rotatory shaft 8*a* of the impression cylinder 8 and the spur gear 51 is in engagement with the spur gear 15 of the blanket cylinder 7. The spur gear 51 (hereinafter referred to as the transmission gear 51) is mounted through bearing 53 on the rotatory shaft 8*a* while the spur gear 52 (hereinafter referred to as the output gear 52) is mounted directly on the rotatory shaft 8*a*, and the differential device 23 is provided between the two gears 51, 52**.

As abovementioned, the differential device 23 is also referred as to a harmonic drive and comprises the ellipsoidal wave generator 32, the flex spline 30 deformable into an ellipsoidal form by the rotation of the wave generator 32, and a pair of circular splines 34, 35, each provided with internal teeth which are engageable with the longitudinal portion, of the flex spline 30.

Figure 8:
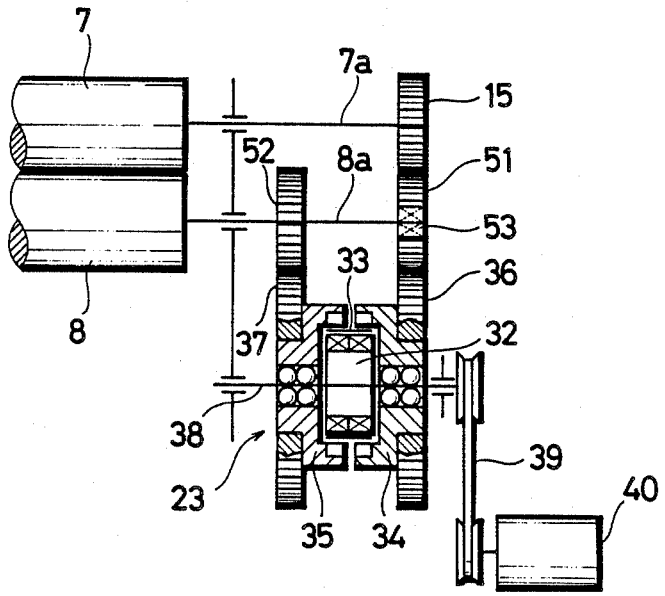
FIG. 8 is a view illustrating the principle of the operation of a differential device similar to that of FIG. 3 used as a speed change means in the second embodiment.

The principle of the operation of the differential device 23 will be described with reference to FIGS. 7 to 9. One circular spline 34 is engaged through a spur gear 36 with the transmission gear 51, while the circular spline 35 is engaged through the spur gear 37 with the output gear 52. The wave generator 32 is mounted on the regulating spindle 38 so as to be integratedly rotatable with the regulating spindle 38. And the regulating spindle 38 is rotatively driven through the belt transmission mechanism 39 by the regulating motor 40. The rotatory power of the transmission gear 51 is transmitted to the output gear 52 in the course of the spur gear 6→the circular spline 34→the flex spline 33→the circular spline 35→the spur gear 37. On the other hand, the rotatory power of the regulating motor 40 is transmitted in the course of the belt transmission mechanism 39→the regulating spindle 38→the wave generator 32, and by the rotation of the wave generation 32, the flex spline 33 is deformed into an ellipsordal form and at the same time the longitudinal portion of the flex spline 33 comes into engagement successively with the internal teeth of the circular splined 34, 35. In this case, since the number of the teeth of the flex spline 33 is smaller by a few (e.g. by two) than that of the circular splines 34, 35, the flex spline 33 is moved in the corresponding distance in the direction opposite to the direction of the rotation of the wave generator 32. This movement is taken out as a differential output by the output gear 52, and thereby the impression cylinder 8 is rotated at the speed determined by the differential device 23.

The output rotation speed of the differential device 23 can be freely hanged by controlling the rotation speed of the regulating motor 40, and thereby the speed ratio of the impression cylinder 8 to the blanket cylinder 7 of each printing section 5 can be controlled. When the rotation of the regulating motor 40 is stopped, the ratio of the input speed to the output speed of the differential device 23 is R:(R+1). Here, R is the reduction gear ratio of the differential device 23.

The rotation speed of the impression cylinder 8 of each printing unit 5, namely, the paper transfer speed of the printing section 2 can be freely controlled as abovementioned. Therefore, the printing pitch can be maintained uniform by reducing the rotation of the impression cylinder 8 thus to lower the paper transfer speed when the paper thickness is larger than the standard value, and by controlling reversely when the paper thickness is smaller. Consequently, it can be surely prevented that the obtained print is blurred due to the disharmony of the rotation speed of the blanket cylinder 7 with the paper transfer speed and that a high tension is applied on the paper web P and the paper transfer mechanism between the printing section 2 and the paper feed section 1 or the processing section 3 due to the change of the printing pitch. Further, when the difference of the paper transfer speed between the printing units 5 . . . is caused by the difference of the diameter of the impression cylinders, by controlling the paper transfer speed of one or both of the units 5 as abovementioned a high tension can be prevented from being applied on the paper web P and the paper transfer mechanism between the printing unit 2 and the paper feed section 1 or the processing unit 3.

Figure 9:
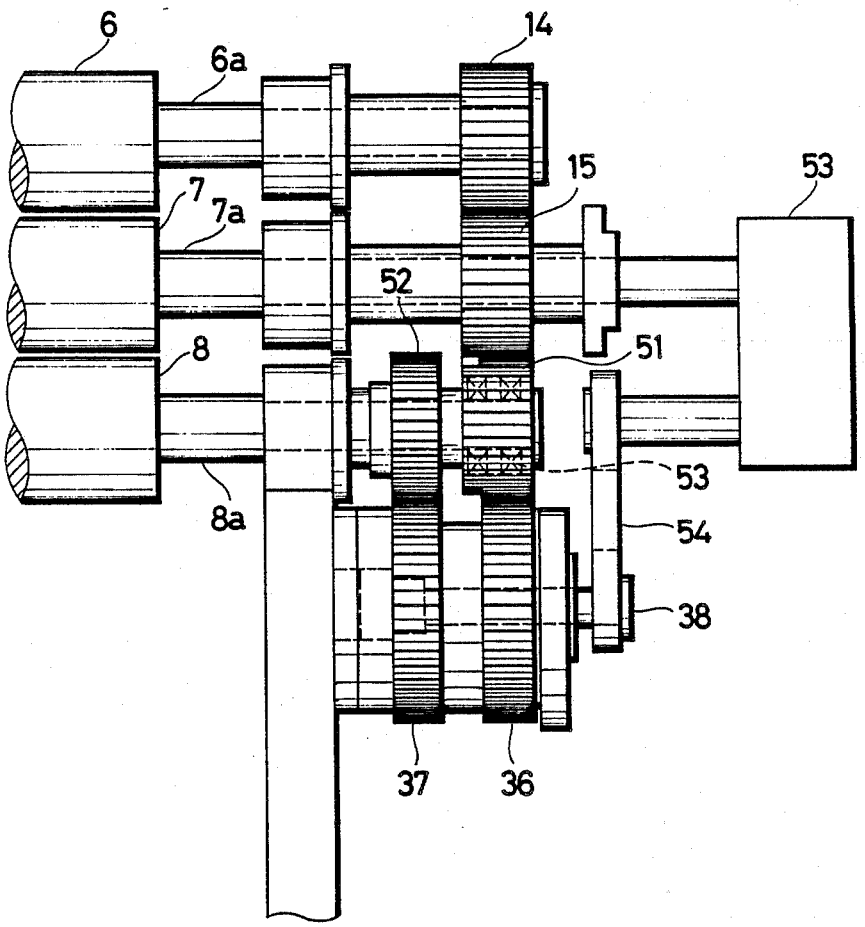
FIG. 9 is a view similar to FIG. 7 illustrating another example of the differential device.
Figure 10:
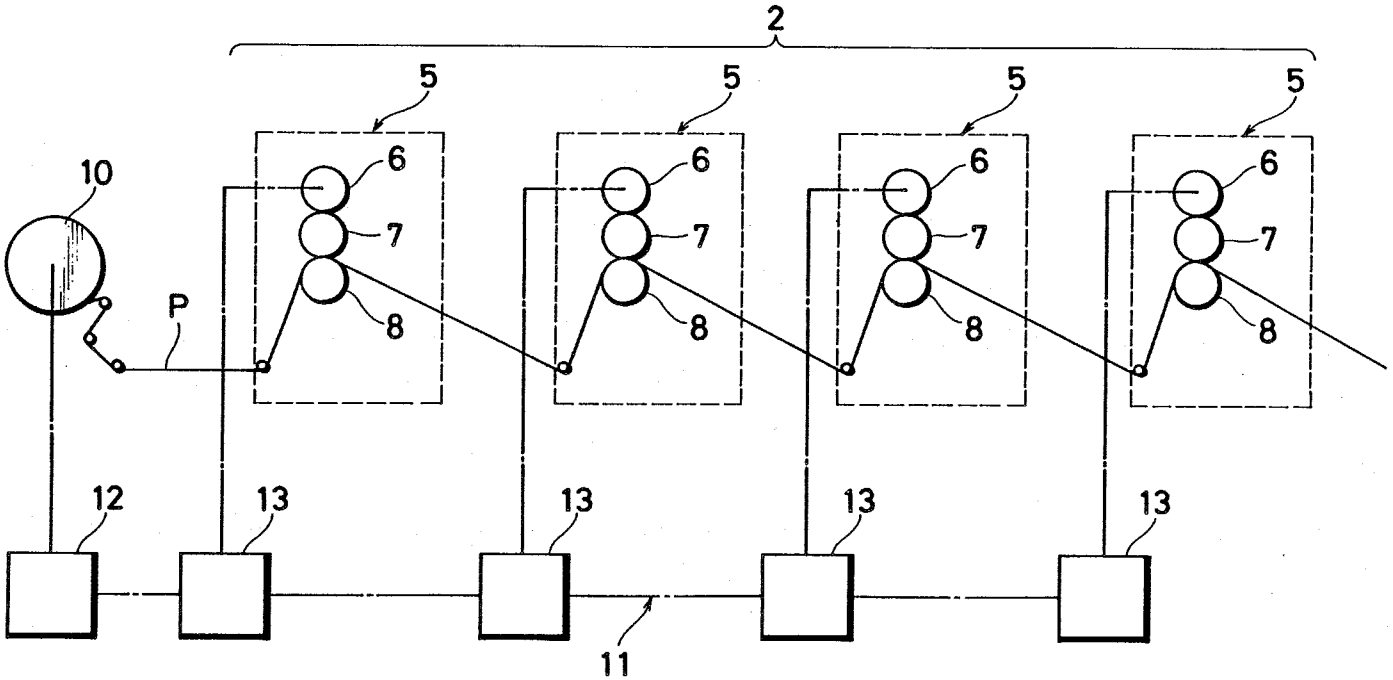
FIG. 10 is a view similar to FIGS. 1 and 6 illustrating the prior art.
Figure 11:
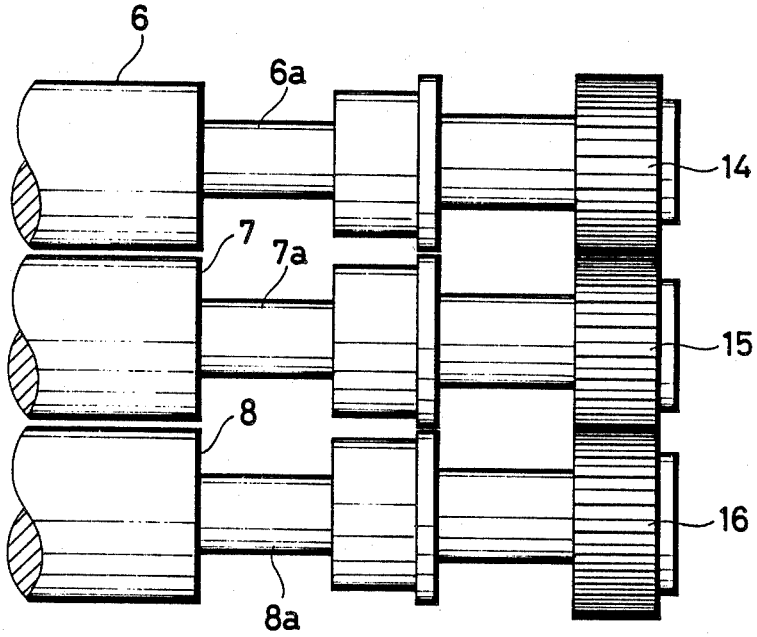
FIG. 11 is a view similar to FIG. 7 illustrating the drive system of the printing unit in the prior art.
Figure 12:
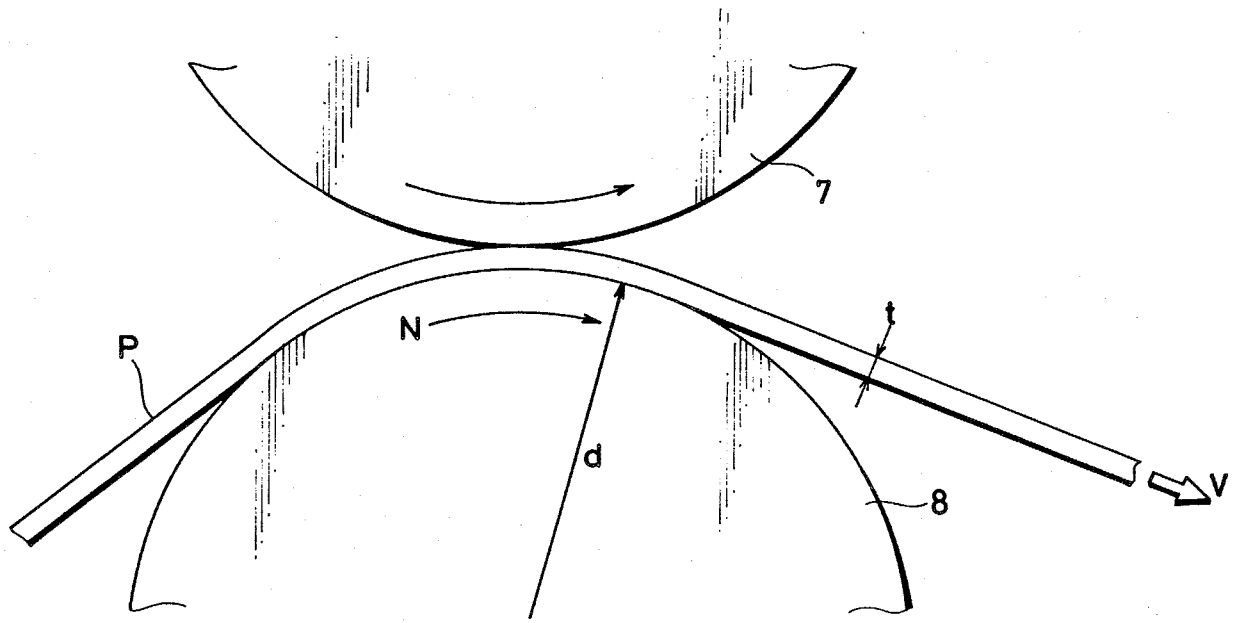
FIG. 12 is a partly extended front view of the drive system.
Figure 13:
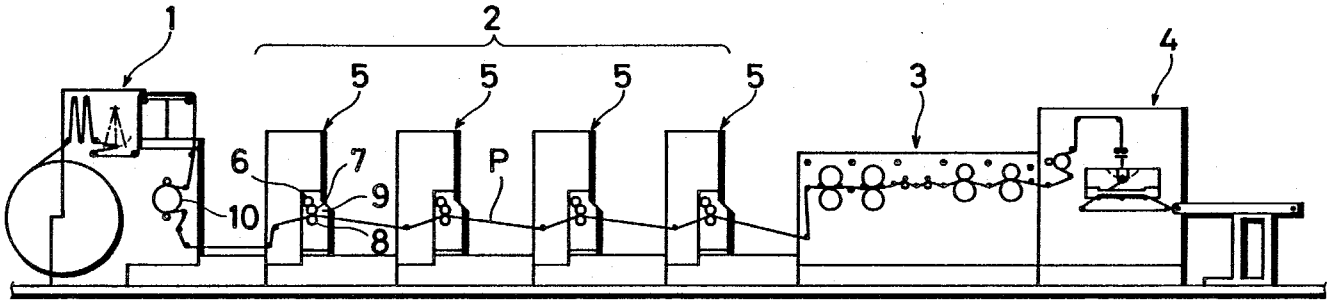
FIG. 13 is a view illustrating the whole structure of the form printing machine.

Another example of the differential device 23 is shown in FIG. 9. In the abovementioned embodiment, the regulating spindle 38 is rotatively driven by another drive source i.e. the variable-speed regulating motor 40, but in the example shown in FIG. 9, the rotatory power of the blanket cylinder 7 is introduced into a gear type or other speed change device 53 the reduction gear ratio of which can be controlled by manual operation, and the output thereof is transmitted through the belt transmission mechanism 54 to the regulating spindle 38 so as to function as a drive force.

The speed change means for collectively controlling the speeds of the impression cylinders 8 . . . of the printing units 5 . . . is not limited to the above mentioned differential device 23 but may comprise a gear type, belt type or other general speed change device. However, the use of the differential device 23 shown in the above mentioned embodiment is advantageous in that fine speed change control can be thereby achieved with a high accuracy.

The second embodiment can be applied not only to a multicolor printing machine but also to a monocolor printing machine having only one printing unit. In the case of a monocolor printing machine, the lowering on the printing precision caused by the change of the paper thickness in the printing unit and a high tension application to the paper web and the paper transfer mechanism between the printing unit and the paper feed section or the processing section can be prevented.

With the use of the apparatus of the second embodiment, as above mentioned, the rotation of the blanket cylinder of each printing unit of the printing section is transmitted through the speed change means such as the differential device to the impression cylinder, and the rotation speed of the impression cylinder, namely, the paper transfer speed can be controlled by the speed change means. Consequently by controlling the paper transfer speed in correspondence with the paper thickness, the difference of the diameter of the impression cylinder between the printing units and the like, the printing pitch can be always suitably maintained thus to improve the printing precision and at the same time a high tension application to the paper web and the paper transfer mechanism between the printing section and the paper feed section or the processing section or a plurality of printing units of a multicolor printing machine is prevented, whereby the life span of the paper transfer mechanism of each section can be increased.

What is claimed is:

1. An apparatus for controlling paper transfer speed of a printing section of a form printing machine in which a plurality of printing units each comprising a plate cylinder, a blanket cylinder and an impression cylinder are arranged on a printing line so as to constitute the printing section, characterized in that a first and second drive shafts driven by a motor as a drive source are provided so as to extend over all of the printing units, the plate cylinder and the blanket cylinder of each printing unit being interlockingly connected to the first drive shaft and the impression cylinder being interlockingly connected to the second drive shaft, and at the end of the second drive shaft on the side of the drive source, a speed change means is provided for changing the rotation speed of the second drive shaft independently of the first drive shaft.

2. An apparatus for controlling paper transfer speed of a printing section of a form printing machine in which a printing unit comprises a plate cylinder, a blanket cylinder and an impression cylinder, and a rotatory force from a single drive source is transmitted through a rotatory power transmission means provided on a drive shaft of each cylinder successively to each of three cylinders, characterized in that between the rotatory power transmission means of the blanket cylinder and that of the impression cylinder, a speed change means is provided for changing the rotation speed of the impression cylinder independently of the plate cylinder and the blanket cylinder.

* * * * *